United States Patent [19]

van Laar et al.

[11] 4,139,183

[45] Feb. 13, 1979

[54] REFRACTORY-LINED SHAFT FURNACE CONTAINING FREE CARBON

[75] Inventors: Jacobus van Laar, Santpoort; Wilhelmus A. J. Kastelic, Ijmuiden, both of Netherlands

[73] Assignee: Hoogovens Ijmuiden, B. V., Ijmuiden, Netherlands

[21] Appl. No.: 723,284

[22] Filed: Sep. 14, 1976

[30] Foreign Application Priority Data

Sep. 17, 1975 [NL] Netherlands ..... 7510905

[51] Int. Cl.[2] ..... C21B 7/06

[52] U.S. Cl. ..... 266/197; 266/280

[58] Field of Search ..... 266/190–194, 266/197, 198, 280, 282–286, 189

[56] References Cited

U.S. PATENT DOCUMENTS

| | | | |
|---|---|---|---|
| 486,110 | 11/1892 | Kennedy | 266/193 |
| 628,790 | 7/1899 | Gaines et al. | 266/193 |
| 2,124,437 | 7/1938 | Steinbacher | 266/189 |
| 3,810,610 | 5/1974 | Berczynski | 266/286 |
| 3,953,007 | 4/1976 | van Laar | 266/280 |

OTHER PUBLICATIONS

Publication: Carbon Hearths in Republic Blast Furnaces; by the American Institute of Mining & Metallurgical Eng.; 1948.

Carbon Hearths in Republic Blast Furnaces; American Institute of Mining & Metallurgical Eng.; 1948.

Unger; Blast Furnace & Steel Plant; Apr. 1948; pp. 434–438.

*Primary Examiner*—Gerald A. Dost

*Attorney, Agent, or Firm*—Stevens, Davis, Miller & Mosher

[57] ABSTRACT

Shaft furnace having a shell, a refractory lining along at least part of its inner surface of a material which contains at least 50% free carbon, and which furthermore is provided with a water-cooled tuyere which is in contact with the refractory lining, including at least one extra layer of a material provided below the cooled tuyere in the refractory lining, over at least part of its thickness and substantially transversely to the direction towards the cooled tuyere which at the temperature of this layer during operation cannot locally react chemically with water and/or with the reaction products of water and carbon and a closed circular gutter which is connected to one or more de-watering openings through the shell, at least one of the extra layers at the side of the furnace shell being connected to said gutter.

6 Claims, 3 Drawing Figures

REFRACTORY-LINED SHAFT FURNACE CONTAINING FREE CARBON

Figure 1:
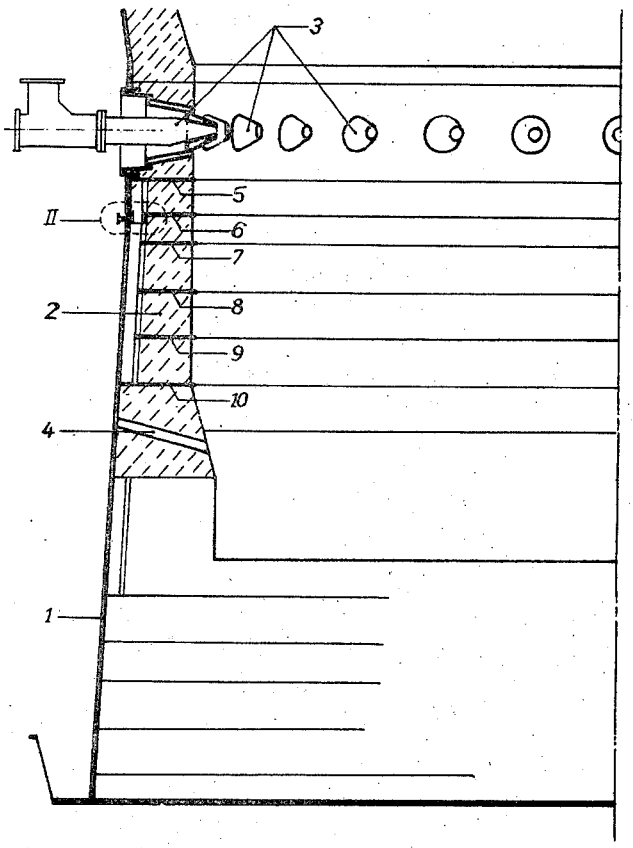

The invention relates to a shaft furnace, having along at least part of its inner surface a refractory lining consisting of a material which contains at least 50% free carbon, and which furthermore is provided with a water-cooled element, which is in contact with the refractory lining. If in this specification mention is made of free carbon, no distinction is made between carbon as a modification of graphite, semi-graphite, etc, unless indicated differently. In principle the invention will be explained in connection with a blast furnace for iron ore reduction, which is provided with tapholes, water cooled tuyers, and possibly a water cooled cooling plate, although the invention is expressly not restricted thereto. On the contrary, one can conceive of many furnace constructions in which problems may occur similar to those to be described hereunder, which may be prevented by applying the construction according to the invention.

Carbon bricks, semi-graphite bricks and graphite bricks, and also carbon-containing masses have been found to be very suitable in their applications in refractory linings of blast furnaces, especially in connection with the hearth and partially the bosh of the blast furnace. The hearth wall then may for instance be lined entirely with carbon and/or graphite bricks, but it is also possible that the carbon and/or graphite is only a portion of the entire substance of the refractory brick, or alternatively that carbon and/or graphite bricks are applied in combination with other bricks, and/or masses. For instance it is possible to apply a further chamotte-layer inside a lining of carbon and/or graphite, to serve as a wear layer.

Because of the excellent refractory properties of carbon-containing materials, but also with a view to the relatively low thermal expansion of these materials at increased temperature, a so-called "black" lining of a blast furnace hearth has proved in practice to be very favourable.

Under certain circumstances however, such a lining may present difficulties, for instance in the event that a water-cooled element, for instance a tuyere, starts leaking, which results in water penetrating the furnace. During the reaction of water with carbon both water and carbon gasify according to reactions know per se, in which the lining is attacked. Particularly this phenomenon is dangerous if there forms a so-called "water corridor" or "water hole" through the refractory lining in the direction of an opening in the furnace-wall, such as for instance a taphole. If such a situation occurs, as a rule a breakthrough of the furnace becomes inevitable.

It has been found that the problem described above may be prevented by the application of the construction of a blast furnace according to the invention.

The invention consists in that below the cooled element in the refractory lining, over at least part of the thickness thereof, and substantially in a direction transverse to the direction to the cooled element, at least one extra layer of a material is included in the lining, said material being selected so that at the temperature of this layer during operation it cannot locally react chemically with water and/or with the reaction product of water and carbon.

Because of this new construction the consequences of the formation of a water hole or water corridor are restricted, because this can extend no further than to the extra layer. If thereupon the leakage of the relevant water cooled element is repaired, it is found that the resulting cavity in the refractory lining often fills up again with slag, or else it is possible to fill it from the outside by means of an injected mass.

It will be clear that the invention is not restricted to the application of one single extra layer of this material in the entire furnace lining, but that it is really possible to reinforce the aimed effect aimed at by installing a multitude of extra layers, either in parallel or in series.

Although the main requirement to be set for the material of the extra layer is just that it should not react or should hardly react chemically with water and/or with the reaction products of water and carbon, it was yet found in practice that preference is to be given to the use of copper plate. It is also remarked that in the art there is a prejudice against providing uncooled metal parts in the refractory lining, because of the risk of their melting. The cavity resulting from such melting out could then give rise to the formation of a breakthrough in the furnace wall. It was found, however that the very high heat-conductivity properties of copper, in connection with the relative high melting point thereof at small thickness, makes the application of copper plate at these places in the furnace construction possible. The copper plate adapts to the temperture of the lining at any place, and hence is relatively insensible to what happens more towards the inside of the furnace. It is clear that near the inside of the refractory lining the copper may weaken or even melt locally but this does not result in total melting away of the copper plate across the thickness of the lining. Rather will slag penetrate locally where the copper has melted away and a cavity has resulted and upon solidifying this slag will repair the lining again, and extra isolation between the copper plate and the firefront is obtained.

Where above there is mention of the material copper, it will be clear that this expression also includes all such metals and metal-alloys, mainly copper alloys, which do not differ substantially from copper in respect of heat-conductivity, weakening properties and melting point.

It will also be clear that the thermal adaptation of the copper plate to the refractory lining is only possible with restricted thickness of the copper plate, which leads to the preferred use according to the invention of copper plate with a thickness of 0.3 to 1 mm.

More particularly a satisfactory construction is obtained with a shaft-furnace in which a taphole is present at a place beneath the water cooled element, if according to the invention an extra layer of the described type is provided at least concentric with the taphole and/or the water-cooled element.

It should be prevented that, with a serious water leakage from a tuyere, large quantities of water penetrate through a water corridor on top of one of the extra layers in such quantities that the water flows over from the extra layer either into the furnace, or down along the furnace shell. To that end at least one of the extra layers may according to the invention be connected to a closed circular gutter at the side of the furnace shell, said gutter being constructed with a de-watering opening in the shell. It is remarked that a de-watering gutter is known per se. It obtains particular value, however, in combination with the extra layers according to the invention.

The invention is illustrated in some figures.

Figure 2:
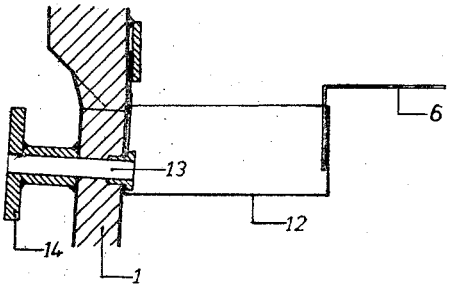
Figure 3:
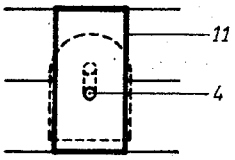

FIG. 1 shows diagrammatically one half of the hearth of a blast furnace designed according to the invention, FIG. 2 shows a detail from FIG. 1, FIG. 3 shows diagrammatically a lining around a taphole of a blast-furnace.

In FIG. 1 reference numeral 1 indicates the steel shell around the hearth of a blast furnace, which on the inside is provided with a refractory lining 2 of graphite. In the hearth there extend tuyeres 3, which have been provided with water cooling in a manner known per se. Near the bottom of the hearth there is provided a taphole 4 which is also designed in a manner known in the art. Upon leakage of the tuyere 3, for instance because its nose melts, water comes into contact with graphite of the furnace lining which results into the formation of a water corridor. If this water-corridor reaches taphole 4, liquid iron may flow through the water corridor into the taphole while the furnace is under pressure, which may lead to a breakthrough.

In between the tuyeres and the taphole, layers of copper plate are provided, schematically indicated 5 to 10. Because of these extra layers 5 to 10 a water corridor may not extend further from the tuyere than the first layer 5, and in case of emergency the second layer 6, etc. The layers 5 to 10 are shaped from plate with a thickness of 0.5 mm. As indicated in FIG. 1 copper plates 5 and 10 extend to the furnace shell, whereas plates 6 to 9 extend for reasons of construction, only into a rammed layer which is provided between the furnace shell 1 and the bricks 2. This difference is not significant for an understanding of the principle of the new invention.

In FIG. 2 the detail II from FIG. 1 is indicated in an enlarged scale. It can be seen therefrom that copper plate 6 is curled downwardly along its outer rim, and then fits into a circular gutter 12 which fits against the furnace shell 1. From this gutter a drilled hole 13 extends through the furnace shell, said opening 13 extending through a flange connection 14. During normal operation, flange 14 may be closed by either a closed flange or a valve. If, as a consequence of water leakage from the tuyere 3, a considerable quantity of water has collected, first on top of plate 6, and from there into gutter 12, it is possible to drain this sytem by connecting the opening 13 in open communication with the outside.

In FIG. 3 a front view onto taphole 4 from the furnace is shown. In this case the taphole is separated from the remainder of the refractory lining by a copper plate 11 which is applied around the taphole as an arch. In a way similar to that described in FIG. 1 this layer prevents the possibility that liquid metal may penetrate into the taphole through a water corridor.

We claim:

1. Shaft furnace having a shell, a refractory lining along at least part of the shell's inner surface of a material which contains at least 50% free carbon, and which furthermore is provided with a water-cooled tuyere which is in contact with the refractory lining, including at least one extra layer of a material provided below the cooled tuyere in the refractory lining, over at least part of its thickness and substantially transversely to the direction from the layer towards the cooled tuyere which at the temperature of this layer during operation cannot locally react chemically with water and/or with the reaction products of water and carbon, said layer being of sufficient size to collect a considerable quantity of water thereby substantially preventing the flow of water from a damaged tuyere through the lining.

2. Shaft furnace according to claim 1 wherein the extra layer consists of copper plate.

3. Shaft furnace according to claim 2 wherein the copper plate has a thickness of between 0.3 and 1 mm.

4. Shaft furnace according to claim 1 including a taphole provided at a place below the water-cooled tuyere, said extra layer of said material being at least partially concentrically with the taphole.

5. Shaft furnace having a shell, a refractory lining along at least part of the shell's inner surface of a material which contains at least 50% free carbon, and which furthermore is provided with a water-cooled tuyere which is in contact with the refractory lining, including at least one extra layer of a material provided below the cooled tuyere in the refractory lining, over at least part of its thickness and substantially transversely to the direction from the layer towards the cooled tuyere which at the temperature of this layer during operation cannot locally react chemically with water and/or with the reaction products of water and carbon and a closed circular gutter which is connected to one or more dewatering openings through the shell, at least one of the extra layers at the side of the furnace shell being connected to said gutter, said layer being of sufficient size to collect a considerable quantity of water thereby substantially preventing the flow of water from a damaged tuyere through the lining.

6. Shaft furnace according to claim 1 wherein said extra layer of said material is at least partially concentrically positioned with respect to the water-cooled tuyere.

* * * * *